United States Patent [19]

Uesugi et al.

[11] Patent Number: 4,854,417

[45] Date of Patent: Aug. 8, 1989

[54] EXHAUST MUFFLER FOR AN INTERNAL COMBUSTION ENGINE

[75] Inventors: Naomoto Uesugi; Hideo Takahashi; Tetsuro Ikeno, all of Saitama, Japan

[73] Assignee: Honda Giken Kogyo Kabushiki Kaisha, Tokyo, Japan

[21] Appl. No.: 225,061

[22] Filed: Jul. 27, 1988

[30] Foreign Application Priority Data

| | | | |
|---|---|---|---|
| Aug. 3, 1987 | [JP] | Japan | 62-194213 |
| Feb. 16, 1988 | [JP] | Japan | 63-019005[U] |
| Feb. 16, 1988 | [JP] | Japan | 63-19006[U] |

[51] Int. Cl.[4] ..... F01N 1/10

[52] U.S. Cl. ..... 181/272; 181/238; 181/240; 181/243; 181/256; 181/264; 181/282

[58] Field of Search ..... 181/230, 238, 240, 243, 181/255, 256, 264, 272, 282, 212

[56] References Cited

U.S. PATENT DOCUMENTS

| | | | |
|---|---|---|---|
| 2,510,440 | 6/1950 | Vokes | 181/212 X |
| 3,798,769 | 3/1974 | Bailey | 181/240 X |
| 4,125,171 | 11/1978 | Morris | 181/265 |
| 4,565,260 | 1/1986 | Scheidt et al. | 181/243 |
| 4,779,415 | 10/1988 | Richardson et al. | 181/240 X |

FOREIGN PATENT DOCUMENTS 62-200112 12/1987 Japan .

*Primary Examiner*—B. R. Fuller
*Attorney, Agent, or Firm*—Lyon & Lyon

[57] ABSTRACT

An exhaust muffler for an internal combustion engine, comprising a hollow casing defining a plurality of chambers which are communicated with each other by way of small holes, an exhaust inlet tube fixedly attached to an exhaust port of an internal combustion engine at its one end and fitted into the casing from a hole provided therein for communication with one of the chambers at its other end, and an exhaust outlet passage communicating another one of the chambers to the atmosphere. The internal end of the exhaust inlet tube and an opposing casing wall are joined by a threaded fastener while the exhaust inlet tube is provided with an annular shoulder surface which fits into the hole of the casing in an air tight fashion, so that the mounting of the muffler can be accomplished simply by fitting the casing of the muffler onto the exhaust inlet tube which is typically attached to a cylinder head of an internal combustion engine in advance and tightening the threaded fastener.

9 Claims, 4 Drawing Sheets

EXHAUST MUFFLER FOR AN INTERNAL COMBUSTION ENGINE

TECHNICAL FIELD

The present invention relates to an exhaust muffler for reducing exhaust noise of an internal combustion engine and, in particular to an improved exhaust muffler having means for facilitating the manufacture and the mounting thereof.

BACKGROUND OF THE INVENTION

The exhaust muffler of an internal combustion engine reduces exhaust noise of the engine by means of volume expansion of the exhaust gas and resonance attenuation in a plurality of chambers defined therein. Conventionally, in a small engine, a muffler is typically directly attached to the exhaust port of the engine by aligning an exhaust inlet of the muffler with the exhaust port of the engine, passing stud bolts provided to the engine through the holes provided in a flange extending radially around the exhaust inlet of the muffler and fastening nuts to the stud bolts.

Fastening such nuts is not necessarily easy because, usually, there is very little space between the engine and the muffler. To eliminate this problem concerning the accessibility to the fasteners for mounting the muffler, the use of stud bolts which are passed completely through the muffler itself was proposed in Japanese Utility Model laid Open Publication No. 62-200112 which was filed by the Assignee of the present application. In this mounting structure, a collar is fitted onto each of the stud bolts in order to control the extent of the collapsing of the muffler as the nuts are tightened. The need for such structural members capable withstanding compression force and relatively long stud bolts not only increases the weight of the muffler but also increases the manufacturing cost due to a large number of component parts required and the substantial labor involved in mounting it.

To overcome this problem, the Inventors have conceived to have the muffler made of two pieces so that the first, smaller piece may be attached to the engine and the second, larger piece may be attached to the first piece afterwards. It would be particularly convenient if the first piece consists of a tubular member serving as an inlet tube leading to the chambers defined in the muffler. In doing so, it is essential to eliminate any possibility of gas leakage from the interfaces between the first piece and the second piece and, yet, to simplify the process of assembling the second piece to the first piece. This is particularly significant because a plurality of chambers are typically defined inside the muffler for reducing exhaust noise and such an inlet tube has to pass through several wall members of the muffler defining these chambers, each time in an air tight manner.

BRIEF SUMMARY OF THE INVENTION

In view of such shortcomings of the preceding proposal and based upon the above mentioned recognitions by the Inventors, a primary object of the present invention is to provide an improved exhaust muffler which can be easily mounted in a limited space.

A second object of the present invention is to provide an improved muffler which consists of a small number of component parts and is light in weight.

A third object of the present invention is to provide an improved muffler which is easy to mount but free from the problems of exhaust gas leakage.

These and other objects of the present invention can be accomplished by providing an exhaust muffler for an internal combustion engine, comprising: a casing defining a hollow space in its interior; an exhaust inlet tube having a first end adapted to be fixedly attached to an exhaust port of an internal combustion engine and a second end fitted into the casing from a hole provided in the casing; and exhaust outlet passage communicating the interior of the casing with atmosphere; the second end of the exhaust inlet tube being provided with first thread means which cooperates with second thread means provided externally of the casing so as to pull the exhust inlet tube into the casing, and an intermediate part of the exhasut inlet tube being provided with an annular shoulder surface which is adapted to fit the exhaust inlet tube into the hole in a substantially air tight fashion.

Therefore, if the exhaust inlet tube has been attached to a cylinder head of an internal combustion engine in advance, the casing can be readily mounted thereon, without requiring any large space for the mounting work. Further, even though the muffler consists of at least two separate pieces which must be connected to each other in a sealed relationship, simply fastening the thread means accomplish this at the same time as the two pieces are mechanically joined by the thread means. Particularly if the distance between a shoulder surface of the casing engaging the second thread means and the hole of the casing in a natural state of the casing is larger than the same when the first and the second thread means are fully fastened to each other, the elastic restoring force arising from the deformation of the casing assures secure mechanical connection as well as fully air tight connection between the two pieces.

According to a certain aspect of the present invention, the shouled surface of the casing engaging the second thread means is defined by a shell member which forms a part of the casing. According to another aspect of the present invention, the shoulder surface of the casing engaging the second thread means is defined by an annular collar member extending from a separator wall which divides the interior of the casing into a plurality of chambers. Thus, in either case, the deformation of the casing produces an elastic restoring force which tends to improve the close fit between the casing and the exhaust inlet tube. In the latter case, the outer shell member may consists solely of glass wool and other materials which are not capable of withstanding the force arising from the fastening of the thread means.

A particularly favorable air-tight connection between the two pieces can be accomplished if the annular shoulder surface of the exhaust inlet tube consists of a taper which converges toward the interior of the casing.

According to a preferred embodiment of the present invention, the casing comprises a pair of shell members which are crimped to each other at their peripheral portions and a layer of lining provided on inner surfaces of the shell members and, to the end of assuring a secure crimping effect, a plurality of spacer members are interposed between the peripheral portions of the shell members. Each of the spacer members may consist of a sheet metal folded around an edge of a separator wall member interposed between the crimped peripheral portions of the shell members. Preferably, each of the spacer members is additionally provided with a rib which is bent therefrom away from the separator wall. This simplifies the manufacture of the spacer members and assures the effectiveness of the spacer members in aiding the crimping of the two shell members to each other.

According to a yet another aspect of the present invention, the exhaust inlet tube is additionally passed through a separator wall dividing the internal space of the casing into a plurality of chambers, and a hole provided in the separator wall for receiving the exhaust inlet tube therein is provided with an edge cover comprising an inner circumferential surface closely fitted onto the exhaust inlet tube, an outer circumferential surface loosely fitted into the hole of the separator wall, and a pair of flanges which are folded around a circular edge of the hole of the separator wall and brought closely over either surface of the separator wall adjacent to the hole thereof. Thereby, the problem of precisely aligning the holes provided in several wall members of the casing for receiving the exhaust inlet tube without causing gas leakage can be accomplished in a simple manner.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
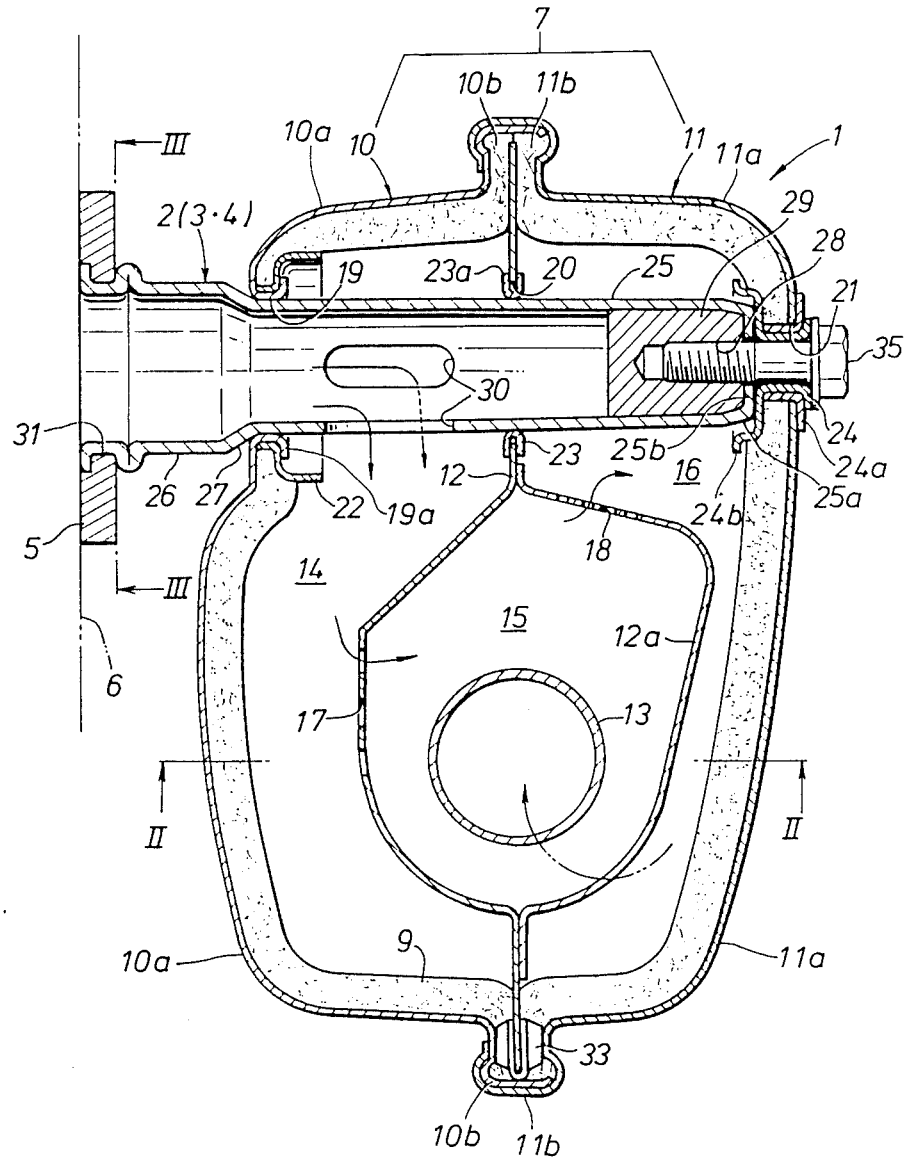
FIG. 1 is a cross sectional view of an exhaust muffler according to the present invention taken along a plane containing the central axial line of one of the inlet tubes of the muffler.
Figure 2:
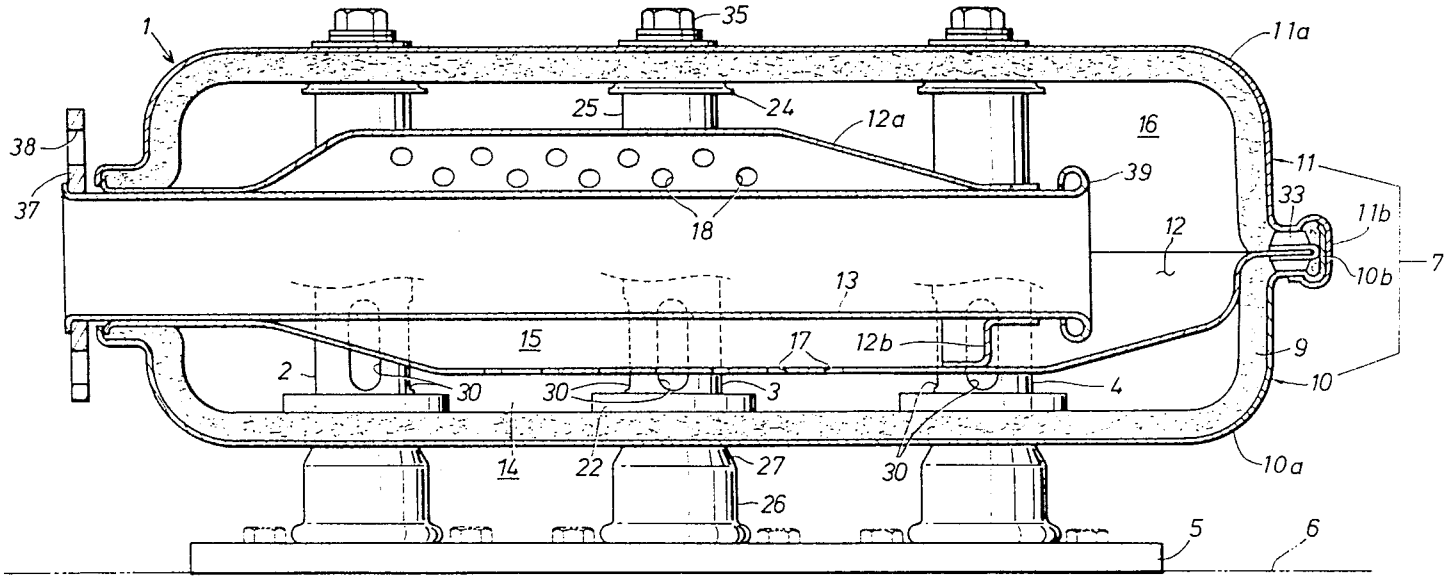
FIG. 2 is a longitudinal sectional view of the muffler shown in FIG. 1 taken along line II—II of FIG. 1.

FIGS. 1 and 2 show an exhaust muffler 1 for a small internal combustion engine according to the present invention. The main body of this muffler consists of an enclosed hollow body or a casing 7, and is fixedly attached to a cylinder head 6 (depicted by an imaginary line) of a three-cylinder engine (not shown in the drawings) by way of exhaust inlet tubes 2, 3 and 4 and a common mounting flange member 5 integrally attached to the exhaust inlet tubes 2, 3 and 4.

The casing 7 comprises an inner half 10 adjacent to the cylinder head 6 and an outer half 11 remote from the cylinder head 6 which are both comprised of shell members 10*a* and 11*a* or stamped sheet metal members and internally provided with a layer of glass wool lining 9. The outer fringes 10*b* and 11*b* of the shell members 10*a* and 11*a* of the two halves 10 and 11 are crimped one over the other with a separator wall 12 interposed therebetween so that they are fixedly attached to one another in an air tight manner. Additionally, an exhaust outlet tube 13 is likewise interposed between the two halves 10 and 11 at the left hand side of the casing 7 of the muffler 1. The exhaust outlet tube 13 is for letting out exhaust gas from the muffler, and is provided with a flange 37 having a pair of holes 38 for receiving mounting bolts (not shown in the drawings) at its one end or its external end and a diverging opening 39 for communication with the interior of the casing 7 at its other end or its internal end.

The interior of the casing 7 is divided into a first chamber 14 defined by the inner half 10 and the separator wal 12, a second chamber 15 defined around the exhust outlet tube 13 by the separator wall 12 and secondary separator walls 12*a* and 12*b*, and a third chamber 16 defined by the outer half 11 and the separator walls 12, 12*a* and 12*b*. The exhaust outlet tube 13 is communicated with the third chamber 12 at its inner end (39). The primary separator wall 12 is provided with a plurality of holes 17 so as to communicate the first chamber 14 with the second chamber 15. The secondary separator wall 12*a* is likewise provided with a plurality of holes 18 so as to communicate the second chamber 15 with the third chamber 16.

Figure 5:
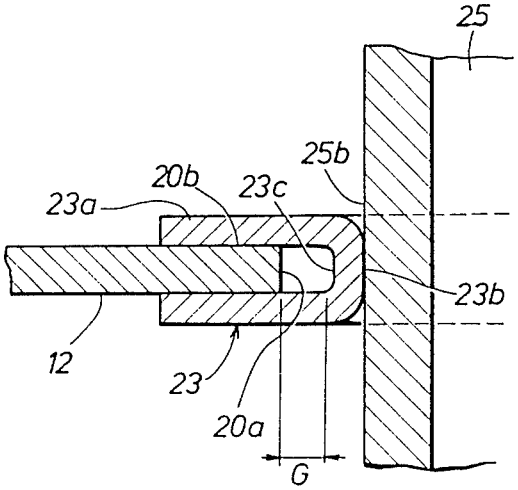
FIG. 5 is an enlarge sectional view showing a part of FIG. 1 in greater detail.

As best shown in FIG. 1, the two halves 10 and 11 and the separator wall 12 are provided with three set of holes 19, 20 and 21, each set extending through the three members in mutual alignment for receiving one of the three exhaust inlet tubes 2, 3 and 4, respectively, therethrough. The fringe 19*a* of each of the holes 19 provided in the inner half 10 or, more specifically, the inner shell member 10*a* is bent inwardly and is crimped over a shoulder surface of an annular member 22 thereby fixedly securing the latter to the fringe 19*a* in a concentric relationship. The inner circumferential edge 20*a* of each of the holes 20 of the separator wall 12 is covered by an annular edge cover 23 which is bent substantially closely over either surface of the separator wall 12 as best shown in FIG. 5. The edge cover 23 comprises an inner circumferential surface 23*b* closely fitted onto the exhaust inlet tube 2, an outer circumferential surface 23*c* loosely fitted into the hole 20 of the separator wall 12, and a pair of radial flanges 23*a* which are folded around a circular edge 20*a* of the hole 20 of the separator wall 12 and brought closely over either surface of the separator wall 12 adjacent to the hole 20 thereof. And, an annular spacer 24 is fitted into each of the holes 21 provided in the outer half 11 or, more specifically, the outer shell member 11*a*. The annular spacer 24 is provided with a pair of annular radial flanges 24*a* and 24*b* which are spaced from each other in the axial direction and bent over either surface of the outer half 11. The axial spacing between the two flanges 24*a* and 24*b* of the spacer 24 receives the glass wool lining 9 therein.

Figure 3:
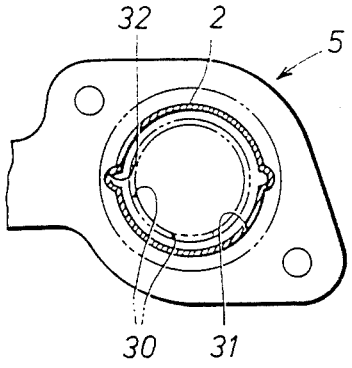
FIG. 3 is a sectional view taken along line III—III of FIG. 1.
Figure 4:
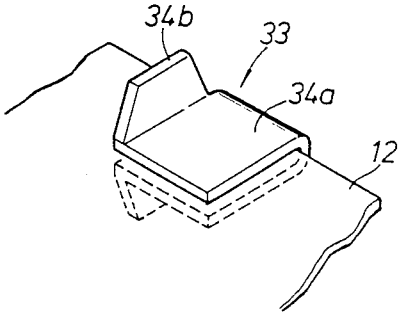
FIG. 4 is an enlarged perspective view of one of the spacers which are used to advantageously join fringe portions of two shell members and a separator wall of the muffler by crimping.

Each of the exhaust inlet tubes 2, 3 and 4 comprises a small diameter portion 25 which is passed into the casing 7, a large diameter portion 26 exposed outside of the inner half 10, and a tapered shoulder portion 27 defined therebetween. The extreme free end of the small diameter portion 25 is provided with a tapered end 25*a* having an radially inwardly directed flange 25*b*. The tapered end 25*a* receives therein a cylindrical block member 29 which is fitted therein from the large diameter end of the exhaust inlet tube 2, 3 or 4 and provided with a threaded hole 28 aligned with an opening defined by the flange 25*b*. Further, each of the exhaust inlet tubes 2, 3 and 4 is provided with a pair of elongated holes 30 in its side wall. These holes 30 provided in each of the exhaust inlet tubes 2, 3 and 4 are circumferentially spaced by 90 degrees and communicate the interior of the corresponding exhaust inlet tube 2, 3 or 4 with the first chamber 14. The outer most end of each of the large diameter portions 26 is fitted into a hole 31 of the common mounting flange member 5 and is integrally attached thereto by crimping. As best shown in Figure 3, the hole 31 provided in the mounting flange member 5 is provided with a pair of diagonally opposed notches 32. By virtue of these notches 32, the exhaust inlet tubes 2, 3 and 4 are positively prevented from rotating about their central axial lines when they are crimped to the flange members 5.

Since the two halves 10 and 11 of the casing 7 is provided with a layer of internal glass wool lining 9, crimping of the fringes of the shell members 10*a* and 11*a* of the two halves 10 and 11 would be difficult with the easily deformable glass wool lining 9 interposed therebetween. Therefore, according to the present invention, a plurality of spacer chips 33 are fitted onto the edges of the separator wall 12 at appropriate interval. Each of these spacer chips 33 is made of stamped sheet metal, and is provided with a main body 34*a* bent around the edge of the separator wall 12 and spot welded to either surface of the separtor wall 12 and a pair of ribs 34*b* which are bent perpendicularly away from the separator wall 12 in either direction so as to extend perpendicularly to the adjacent edge of the separator wall 12. These ribs 34*b* serve as the members for receiving the crimping force which securely joins the fringes of the two shell members 10*a* and 11*a* together, with the separator wall 12 securely interposed therebetween.

If the portion of the glass wool lining 9 adjacent to the crimped portion of the two shell members 10*a* and 11*a* is impregnated with heat-resistant resin material such as epoxy resin, the mechanical strength of this portion can be improved even further.

Now the assembling process of the muffler of the above described embodiment is explained in the following.

First of all, the exhaust inlet tubes 2, 3 and 4 are attached to the cylinder head 6 of an engine by way of the common flange member 5. The main body of the muffler 1 is then fitted onto the exhaust inlet tubes 2, 3 and 4. Threaded bolts 35 are passed into the holes 21 by way of the annular spacers 24 and threaded into the threaded holes 28 of the corresponding cylindrical block members 29. Since the original distance between the internal shoulder surface adjacent to each of the holes 21 and the external shoulder surface adjacent to the corresponding hole 19 is shorter than the corresponding length of each of the inlet exhaust tubes between the free end surface of the small diameter portion 25 and the tapered shoulder portion 27, as the bolts 35 are threaded into the corresponding threaded holes 28 and the casing 7 undergoes a slight elastic deformation, the tapered portions 27 of the exhaust inlet tubes 2, 3 and 4 are press fitted into the corresponding holes 19 defined in the inner shell member 10*a* of the casing 7. At the same time, the free end surfaces of the small diameter portions 25 of the exhaust inlet tubes 2, 3 and 4 are brought into contact with the internal shoulder surfaces of spacer 24 or its inner flange 24*b*. In other words, the distance between the shoulder surface of the outer shell 11*a* engaging the heads of the bolts 35 and the holes 19 of the casing 7 in a natural state of the casing 7 is longer than the same when the threaded bolts 35 are fully threaded into the threaded holes 28 of the cylindrical block members 29. Thus, as the main body of the muffler 1 is mechanically attached to the inlet tubes 2, 3 and 4, the sealing therebetween is accomplished at the same time.

Normally, a casing of this kind is manufactured by press forming or stamping a sheet of steel plate into desired shapes, and it is difficult to obtain a precise alignment between the corresponding holes 19 of the inner half 10 and the holes 20 of the separator wall 12. Thus, it is extremely difficult to achieve necessary precision in fitting the exhaust inlet tubes 2, 3 and 4 into the holes 19 and 20 with a sufficiently close fit in an air tight fashion.

Therefore, according to the present invention, an annular edge cover 23 is fitted around the circular edge 20a defining each of the holes 20 provided in the separator wall 12. This edge cover 23 is provided with an inner circumferential surface 23*b* which receives the small diameter portion 25 of the corresponding exhaust inlet tube, an outer circumferential surface 23*c* which is spaced from the inner circumferential edge 20*a* of the hole 20 of the separator wall 12 by a distance G, and a pair of flanges 23*a* which are closely bent over either surface of the separator wall 12. Thus, the annular edge cover 23 is engaged to the separator wall 12 in a substantially air tight fashion by way of the flanges 23*a* but is allowed to move relative to the separator wall 12 along its major surface. Therefore, the edge covers 23 can accommodate a deviation in the alignment between the inlet tubes 2, 3 and 4 and the holes 19 and 20 when the inlet tubes 2, 3 and 4 are fitted into the holes 19 and 20 and the threaded bolts 35 are threaded into the treaded holes 28. Since the small diameter portion 25 are subtantially closely fitted into the inner circumferential surfaces 23b of the edge covers 23, the sealing between the first chamber 14 and the third chamber 16 can be assured.

The exhaust gas which is introduced into the first chamber 14 by way of the exhaust inlet tubes 2, 3 and 4 and the elongated holes 30 thereof. The exhaust gas then flows into the second chamber 15 by way of the holes 17 provided in the separator wall 12, and flows into the third chamber 16 by way of the holes 18 provided in the secondary separator wall 12a. The exhaust gas in the third chamber 16 flows into the outlet tube 13 from its internal end 39 and is expelled to the atmosphere from the external end of the outlet tube 13. The exhaust gas thus flows from one chamber into another by way of small holes each time with the result that the noise of the exhaust gas is effectively attenuated by virtue of volume changes and resonance attenuation.

Figure 6:
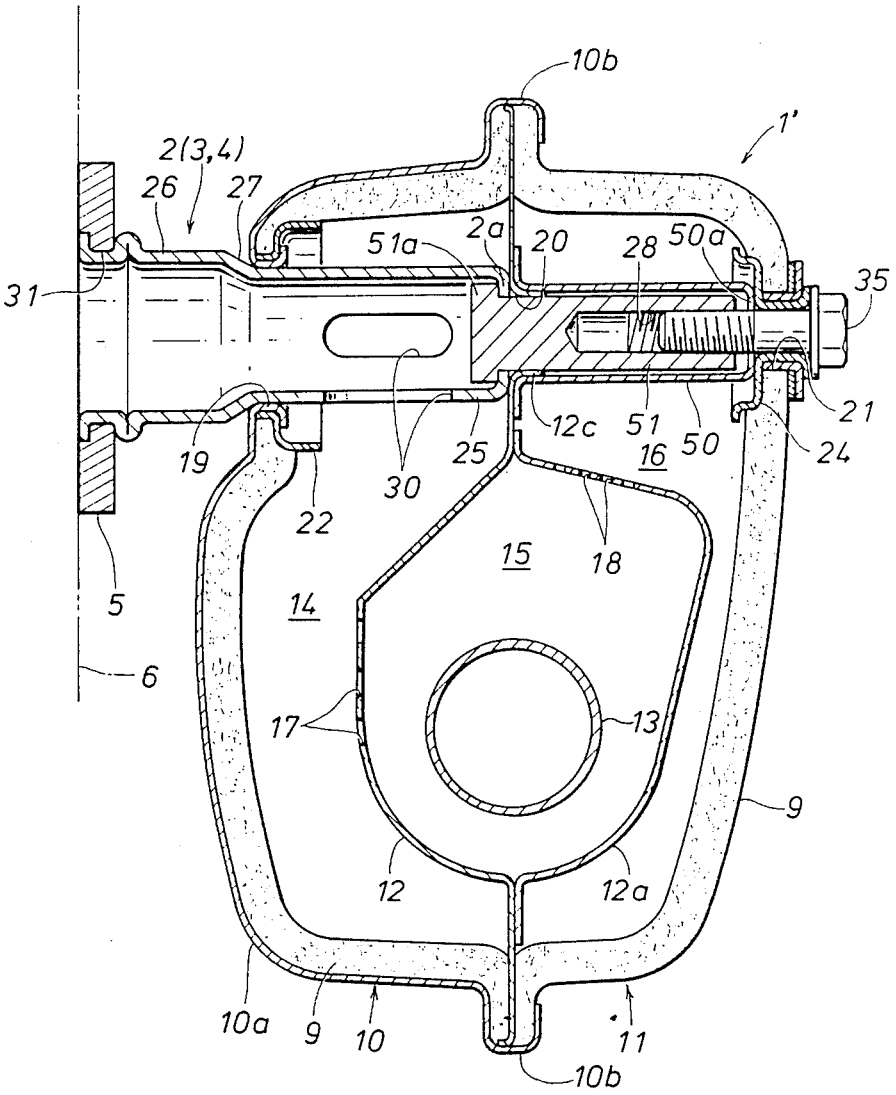
FIG. 6 is a view similar to FIG. 1 showing an alternative embodiment of the present invention.

FIG. 6 shows a second embodiment of the present invention. In FIG. 6, the parts corresponding to those of the previous embodiment are denoted with like numerals and their description is not repeated here. In this embodiment, the exhaust inlet tubes 2, 3 and 4 terminate at the separator wall 12 and are provided with inwardly directed flanges as represented by the flange 2*a* of one of the exhaust inlet tubes 2. The hole 20 provided in the separator wall 12 is defined by an annular, axial projection 12*c* which is bent from the separator wall 12 and is directed to the third chamber 16. A tubular member or a collar 50 is fitted onto this annular, axial projection 12*c*, and its other end provided with an inwardly directed radial flange 50*a* abuts the internal end surface of the annular spacer 24. The cylindrical block member 51 is received in this tubular member 50 and is provided with an externally directed radial flange 51*a* which engages a shoulder surface defined by the inner surface of the flange 2*a*.

In this embodiment, the outer half 11 consists solely of a press formed glass wool lining 9 as opposed to the previous embodiment.

According to this embodiment, the assemblng process is substantially identical to that of the previous embodiment, but as the bolt 35 is threaded into the threaded hole 28, the flange 2*a* of the exhaust inlet tube 2 is pulled towards the separator wall 12 and the tapered portion 27 of the exhaust inlet tube 2 is fitted into the hole 19 as the hollow body including the inner half 10 and the separator wall 12 undergoes an elastic deformation to a certain extent. At the same time, the collar 50 transmits the force produced by the threading of the bolt 35 into the hole 28, as a compression force to the separator wall 12 and the flange 2*a* of the exhaust inlet tube 2. Thus, the outer half of the casing 7 which consists solely of glass wool is not required to support any of the force which tends to fit the exhaust inlet tube 2 into the hole 19.

What we claim is:

1. An exhaust muffler for an internal combustion engine, comprising:

a casing defining a hollow space in an interior thereof;

an exhaust inlet tube having a first end adapted to be fixedly attached to an exhaust port of an internal combustion engine and a second end fitted into the interior of the casing from a hole provided in a wall of the casing;

an exhaust outlet passage associated with said hollow space and communicating the interior of the casing with the atmosphere;

the second end of the exhaust inlet tube being provided with first thread means which cooperates with second thread means provided externally of the casing so as to pull the exhaust inlet tube into the casing, and an intermediate part of the exhaust inlet tube being provided with an annular should surface which is adapted to fit the exhaust inlet tube into the hole in a substantially air tight fashion.

2. An exhaust muffler for an internal combustion engine as defined in claim 1, wherein a distance between a shoulder surface of the casing engaging the second thread means and the hole of the casing in a natural state of the casing is longer than the same when the first and the second thread means are fully fastened to each other.

3. An exhaust muffler for an internal combustion engine as defined in claim 2 wherein the shoulder surface of the casing engaging the second thread means is defined by a shell member forming a part of the casing.

4. An exhaust muffler for an internal combustion engine as defined in claim 2, wherein the shoulder surface of the casing engaging the second thread means is defined by an annular collar member extending from a separator wall which divides the interior of the casing into a plurality of chambers.

5. An exhaust muffler for an internal combustion engine as defined in claim 2, wherein the exhaust inlet tube comprises an annular shoulder surface which consists of a taper which converges toward the interior of the casing.

6. An exhaust muffler for an internal combustion engine as defined in claim 2, wherein the casing comprises a pair of shell members which are crimped to each other at peripheral portions thereof and a layer of lining provided on inner surfaces of the shell members, a plurality of spacer members being interposed between the peripheral portions of the shell members.

7. An exhaust muffler for an internal combustion engine as defined in claim 6, wherein each of the spacer members comprises a sheet metal folded around an edge of a separator wall member interposed between the crimped peripheral portions of the shell members.

8. An exhaust muffler for an internal combustion engine as defined in claim 7, wherein each of the spacer members is additionally provided with a rib which is bent therefrom away from the separator wall.

9. An exhaust muffler for an internal combustion engine as defined in claim 2, wherein the exhaust inlet tube is additionally passed through a separator wall dividing the interior of the casing into a plurality of chambers, and a hole provided in the separator wall for receiving the exhaust inlet tube therein is provided with an edge cover comprising aninner circumferential surface closely fitted onto the exhaust inlet tube, an outer circumferential surface loosely fitted into the hole of the separator wall, and a pair of flanges which are foled around a circular edge of the hole of the separator wall and brought closely over either surface of the separator wall adjacent to the hole thereof.

* * * * *